US007129894B1

(12) United States Patent
Winter

(10) Patent No.: US 7,129,894 B1
(45) Date of Patent: Oct. 31, 2006

(54) SELECTABLE LENGTH MEANDER LINE ANTENNA

(75) Inventor: James Blake Winter, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/908,765

(22) Filed: May 25, 2005

(51) Int. Cl.

| | |
|---|---|
| ***H01Q 1/38*** | (2006.01) |
| ***H01Q 1/50*** | (2006.01) |
| ***H01Q 7/00*** | (2006.01) |
| ***H01Q 3/24*** | (2006.01) |
| ***H01Q 1/36*** | (2006.01) |

(52) U.S. Cl. ..... 343/700 MS; 343/850; 343/868; 343/876; 343/895

(58) Field of Classification Search ..... 343/700 MS, 343/850, 868, 876, 895
See application file for complete search history.

(56) References Cited

U.S. PATENT DOCUMENTS 6,489,925 B1 * 12/2002 Thursby et al. ..... 343/700 MS
6,624,795 B1 * 9/2003 Boyle ..... 343/895
6,894,656 B1 * 5/2005 Apostolos et al. ..... 343/841
2005/0225496 A1 * 10/2005 Apostolos et al. ..... 343/850

* cited by examiner

*Primary Examiner*—Shih-Chao Chen
(74) *Attorney, Agent, or Firm*—Holland & Hart LLP

(57) ABSTRACT

A single antenna element with a switchable extension may be used to change the size of the radiating surface and provide an antenna that has two or more separate center frequencies. The range of frequencies that may be tuned by the antenna is enhanced, while maintaining relatively low complexity tuning and matching circuitry. Switching for the extension is performed by a switching element that is located at the point of connection of the extension to the antenna element. A control line supplies a control signal to the switching element to enable and disable the extension. The control line is positioned in close proximity to the antenna element to enhance coupling between the antenna element and the control line.

20 Claims, 5 Drawing Sheets

SELECTABLE LENGTH MEANDER LINE ANTENNA

FIELD OF THE INVENTION

The present invention is directed to antennas capable of tuning over a large frequency range, and, more specifically, to an antenna with a selectable radiating surface area.

BACKGROUND OF THE INVENTION

Many present day analog and digital devices are capable of receiving and/or transmitting radio frequency (RF) signals. Such devices include, for example, radios, computers, video games, televisions, and wireless telephones. A large of number of these devices are required to tune over many different frequencies with a single antenna in order to operate as required by the particular application. For example, a wireless telephone may need to operate over several different frequency bands in order to tune signals on the different bands, such as a GSM band and an analog band.

As is understood, such systems require antennas having tuning circuitry in order to tune the device to the proper frequency. As frequency ranges increase, the cost and efficiency of the tuning circuitry also increases. Furthermore, the overall efficiency may drop at frequencies that are not within an optimum tuning range of the antenna.

SUMMARY OF THE INVENTION

The present invention provides a relatively compact antenna and system that is capable of tuning RF signals over a relatively large range of frequencies while having relatively simple (and thus relatively inexpensive) tuning circuitry. An antenna element is provided that has a selectable length, thus providing different center frequencies for the antenna element depending upon the selected length of the antenna element. Tuning circuitry may tune the antenna element to a range of frequencies about the center frequency. A control line is used to switch the length of the antenna element, with the control line coupling to the antenna element at substantially the same RF frequencies throughout the range of frequencies the antenna element is required to operate.

In one embodiment, a selectable length meander line antenna system, is provided comprising: (a) a first meander line antenna portion operably interconnected to an RF feed and a tuning circuit; (b) a switch element operably interconnected to the first meander line antenna portion at an end thereof away from the RF feed; (c) a second meander line antenna portion operably interconnected to the switch element; and (d) a control line operably interconnected to a controller and to the switch element. The switch element is operable to receive a signal from the control line and electrically connect the second meander line antenna portion to the first meander line antenna portion. The control line is routed in close proximity to the first meander line antenna portion throughout the entire length of the first meander line antenna portion. The first meander line antenna portion has a first center frequency of operation and a first range of operation, and the first and second meander line antenna portions have a second center frequency and a second range of operation when the switch element electrically connects the first and second meander line antenna portions. The first and second meander line antenna portions may be configured in a serpentine fashion, with the control line configured in a corresponding serpentine fashion corresponding to the first meander line antenna portion. The switch element may comprise two PIN diodes connected in series between the control line and the first and second meander line antenna portions. The switch element may also comprise a MEMS device, a relay, or other switching device.

In another embodiment, the antenna further comprises a second switch element operably interconnected to the second meander line antenna portion at an end thereof away from the RF feed, a third meander line antenna portion operably interconnected to the second switch element, and a second control line operably interconnected to the controller and to the second switch element. In this embodiment, the second switch element is operable to receive a signal from the second control line and electrically connect the second meander line antenna portion to the third meander line antenna portion. The second control line is routed in close proximity to the first and second meander line antenna portions throughout the entire length of the first and second meander line antenna portions.

DETAILED DESCRIPTION

The present invention recognizes that antennas are designed having a center frequency at which the antenna may be tuned with relatively little requirements for tuning and matching circuitry. The antennas include tuning and matching circuitry that are capable of adjusting the antenna properties to tune frequencies over a specified frequency range relative to the center frequency. As this frequency range increases, the complexity (and thus cost) of the tuning and matching circuitry increases, and the efficiency of the antenna may decrease. The present invention thus provides an antenna element with a switchable extension that may be used to change the size of the radiating surface and provide an antenna that has two or more separate center frequencies. Thus, the range of frequencies that may be tuned by the antenna is enhanced, while maintaining relatively low complexity tuning and matching circuitry. Switching for the extension is performed by a switching element that is located at the point of connection of the extension. A control line supplies a control signal to the switching element to enable and disable the extension. The control line is positioned in close proximity to the antenna element to enhance coupling between the antenna element and the control line. The present invention, and some exemplary embodiments thereof, is now described with reference to drawing FIGS. 1–5.

Figure 1:
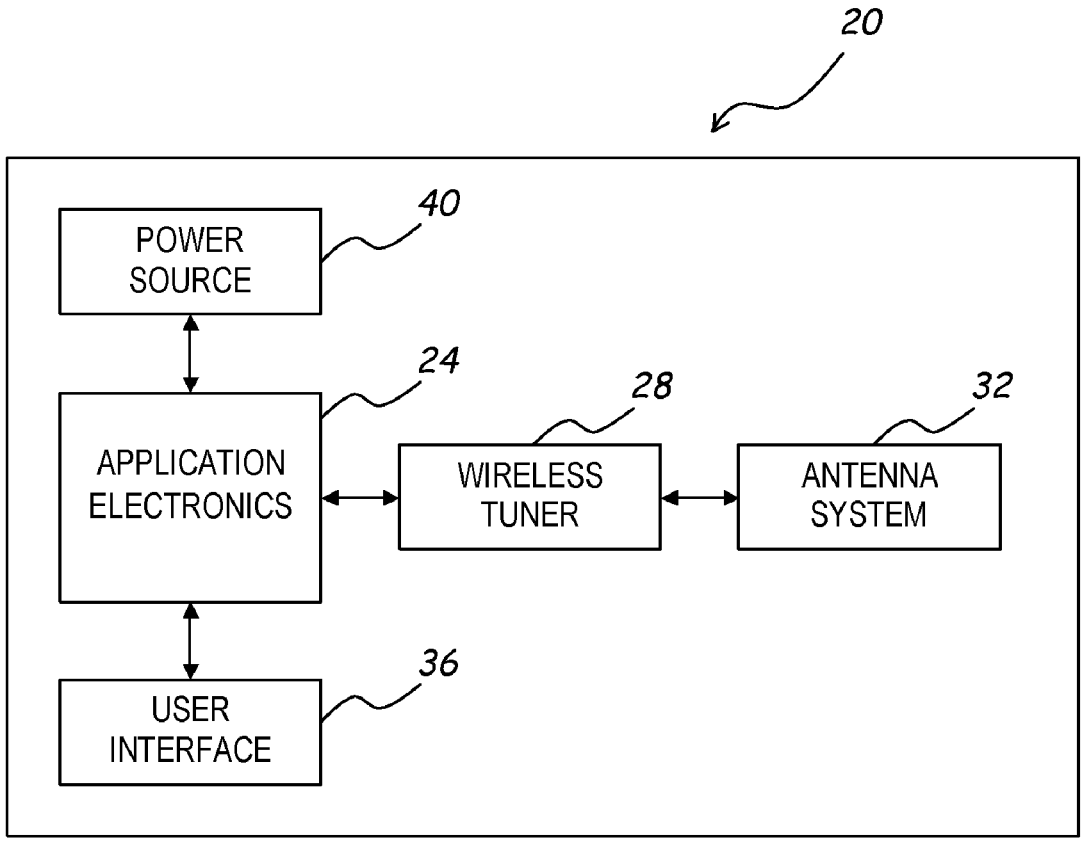
FIG. 1 is a block diagram illustration of an electronic device requiring RF tuning.

FIG. 1 is a block diagram illustration of an RF device 20 of one embodiment of the invention. The RF device 20 may be used to transmit and/or receive radio frequency signals. Such a device may transmit and/or receive radio frequency signals of, for example, television (including digital television), radio (including digital radio), telephone, computing devices (mobile and fixed), among others. The RF device includes application electronics 24 that may use or collect information communicated on RF signals to and/or from the RF device 20. Such application electronics 24 may include a digital signal processor, microprocessor, or memory, and any other appropriate electronic devices for the device. The application electronics provide information and/or receive information from a wireless tuner 28. Such a wireless tuner 28 is of the type that is common for RF devices, including tuning and matching circuitry. The wireless tuner 28 transmits and/or receives a signal to/from the antenna system 32. The antenna system 32, of one embodiment, is a controllable antenna in which the radiating surface of the antenna system is selectable based upon requirements of the RF device 20. The antenna system will be described in greater detail below. The RF device 20 includes a user interface 36, which may be any user interface which may be appropriate for the device. Such an interface may include, for example, a keypad, a keyboard, a display such as a CRT, or any other audio and/or visual interface required for the particular application. A power source 40 provides power to the RF device 20 and may be any available power source used in such an application including an internal (battery) and/or external (standard wall outlet) power source.

Figure 2:
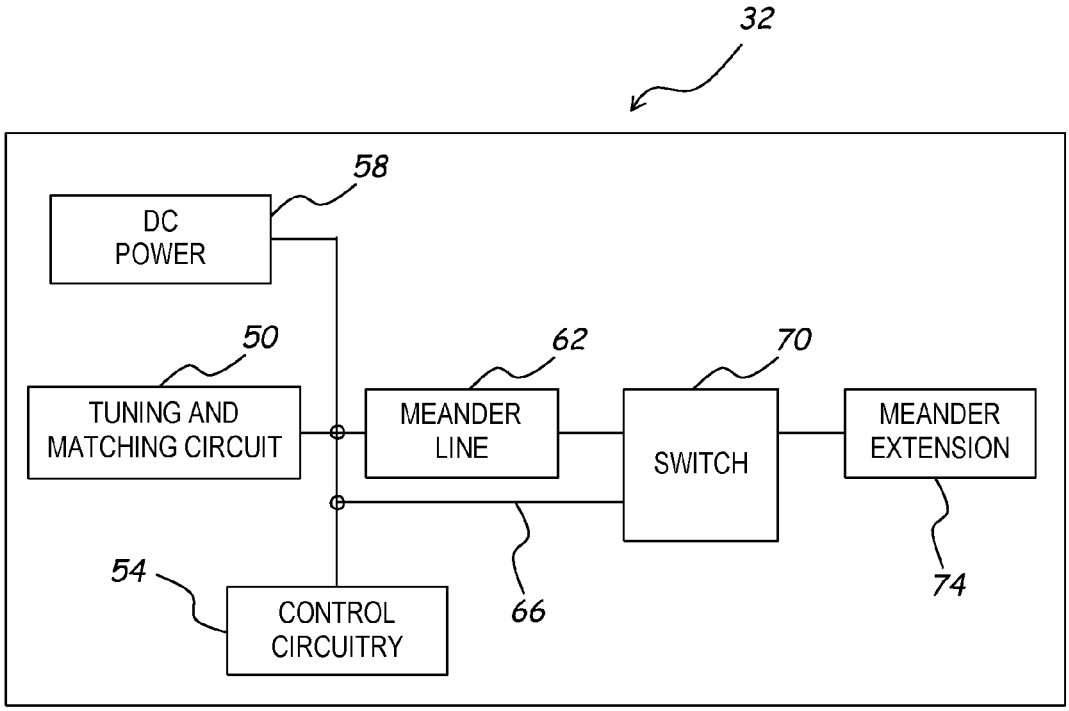
FIG. 2 is a block diagram illustration of an antenna system of an embodiment of the invention.

Referring now to FIG. 2, the antenna system 32 is now described in greater detail. In this embodiment, the antenna system 32 includes a tuning and matching circuit 50. The tuning and matching circuit is any appropriate tuning and matching circuit for the antenna. Control circuitry 54 and a power source 58 are also connected to the tuning and matching circuit, with the output provided to a meander line antenna element 62. Such a meander line is known in the art, and provides a relatively high bandwidth antenna within a relatively small area. Such antennas are useful in applications where it is desirable to have an antenna that is relatively compact. For example, if it is desirable to have a half-wavelength antenna element within a relatively constrained space, a meander line element may be used to provide the appropriate element length within the relatively small space. A control line 66 extends from the control circuitry to a switch 70. The switch 70 enables and disables an electrical path between the meander line 62 to a meander extension 74. Such a switch 70 may include one or more of a number of switching elements, such as PIN diodes, MEMS devices, relays, and field effect transistors (FETs), to name but a few.

In one embodiment, the control line 66 and the meander line 62 are routed in close proximity to one another. Close proximity, as used herein, means that the distance between the control line and meander line is such that the two lines are electrically coupled at the operating frequencies of the meander line and have substantially the same resonance frequencies. The effect of placing the control line 66 in close proximity to the meander line 62 increases the coupling between the control line 66 and the meander line 62 when the antenna is operating. The coupling is further increased by placing relatively large capacitors at various locations, such as the terminal ends, of the meander line 62. These capacitors effectively block DC between the control line 66 and meander line 62 and also serve as a RF short circuit between the control line 66 and the meander line 62. The coupling between the control line 66 and meander line 62 results in the control and meander lines 66, 62 resonating at substantially the same frequencies and providing enhanced bandwidth to the meander line 62. This improvement in bandwidth is the result of having an effectively larger wire for the meander line 62. The control line 66 connects to the switch 70 that connects the meander line 62 with the meander extension 74 thus changing the resonant frequency of the antenna system 32. An RF system employing such an antenna system 32 may thus selectively be enabled to transmit and/or receive RF signals across a wider range of frequencies while still maintaining tuning and matching circuitry 50 which is relatively inexpensive. The tuning and matching circuitry 50 may be designed to provide tuning over a frequency range that is less than the entire operating range required of the antenna system 32.

The switch 70, in one embodiment, is comprised of two PIN diodes. In this embodiment the control signal from the control circuitry 54 is a positive voltage which is connected through the PIN diodes, in series, to the control signal negative. Thus, when the signal from the control circuitry 54 is switched, the extension on the meander line antenna is enabled and/or disabled. As mentioned above, the switch 70 may comprise other components rather than, or in addition to, PIN diodes, such as MEMS devices, relays, and FETs, to name a few. In such cases, the control circuitry 54 provides an appropriate control signal to actuate the switch 70 to enable/disable the meander line extension. The components illustrated in FIG. 2 are illustrative of components that may be used in such a system and it will be understood that one or more of the components described may be integrated together, and that one or more of the components described as a single functional component may be comprised of one or more discrete components within the system.

Figure 3:
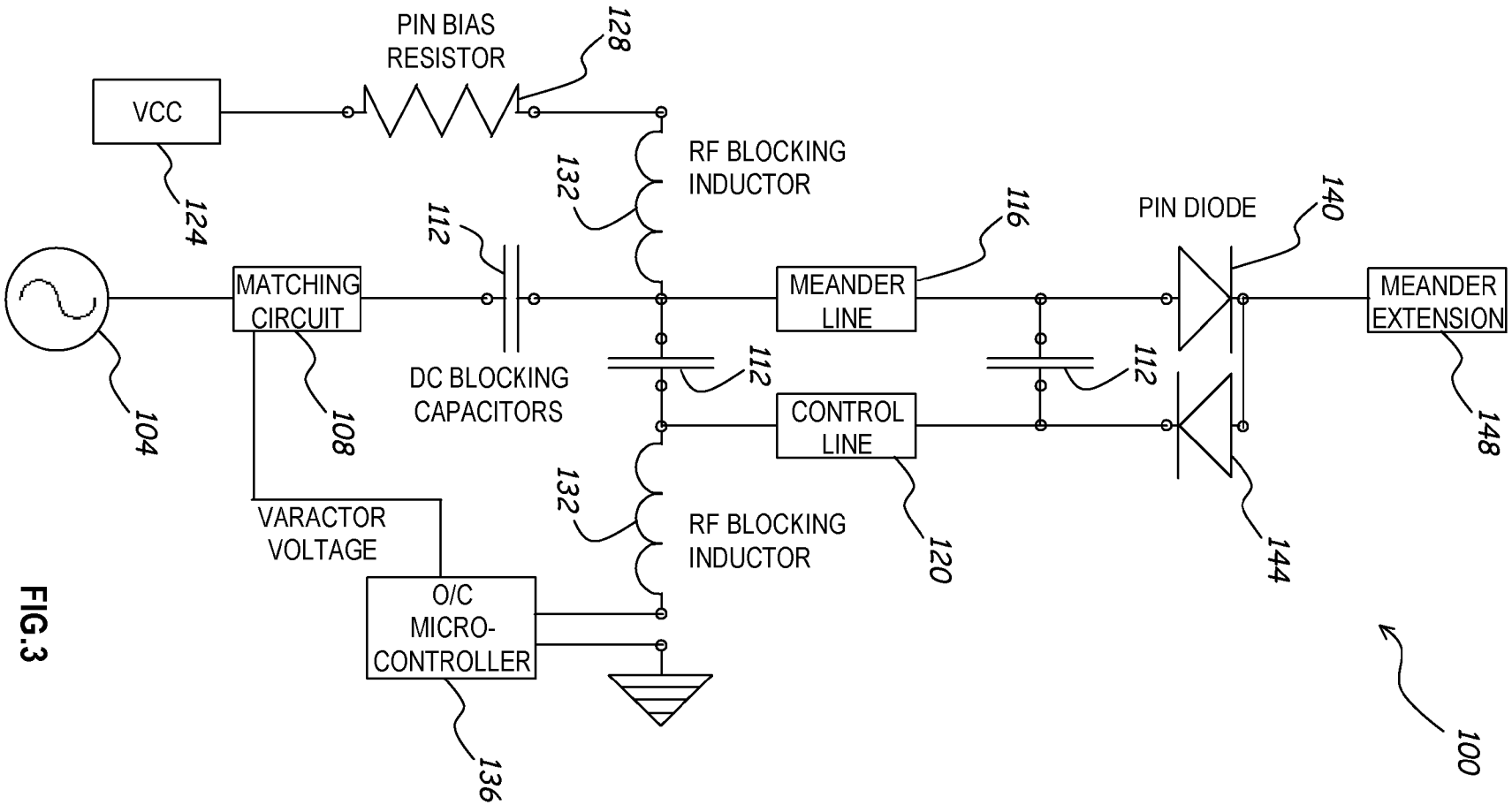
FIG. 3 is a circuit diagram of an extendable meander line antenna of an embodiment of the present invention.

Referring now to FIG. 3, a circuit diagram for an antenna system 100 of an embodiment of the invention is described. A RF source 104 supplies an RF signal to a matching circuit 108. The matching circuit 108, similarly as described above, is any matching circuit appropriate for the application (also referred to as a variable matching network) and provides matching for different frequencies of the antenna system. A DC blocking capacitor 112 is placed in series between the matching circuit and the meander line 116. The DC blocking capacitor 112 is an open circuit to DC signals, and thus passes RF signals while blocking DC signals. The meander line 116, similarly as described above, is a antenna element having a serpentine radiating surface. In one embodiment, the meander line has a center frequency of 600 MHz and the matching circuit 108 is capable of tuning the meander line over a frequency range of 550 MHz to 770 MHz. As will be understood, such an antenna may be designed to have a desired center frequency and the matching circuit and/or any other tuning circuitry may be designed to tune the antenna over other frequency ranges from the center frequency.

A control line 120 runs in close proximity with the meander line 116. As mentioned above, by running the control line 120 in close proximity to the meander line 116, the two lines couple at approximately the same frequency, and thus coupling between the lines is enhanced. Control lines, by nature of their inherent length, couple to antenna elements. In the event that such a control line is routed in a different configuration than the radiating element, the control line will couple with the element at different frequencies than the operating frequency of the element, causing undesirable anti-resonances that reduce the efficiency and effectiveness of a variable matching network. A potential solution to this coupling is the placement of inductors along the length of the control line, thus mitigating the coupling. However, such inductors both increase the cost of the antenna system, and at substantial fractions of a wavelength from the feed point, the antenna impedance increases such that practical inductor sizes do not have enough impedance to block the RF on the control line. Thus, by placing the control line in close proximity to the antenna element, the coupling of the control line and antenna element is increased such that the control line becomes part of the antenna element, thereby reducing or eliminating spurious resonances while also enhancing operating bandwidth of the antenna.

Referring still to FIG. 3, capacitors 112 are also placed at various points between the control line 120 and the meander line 116. These capacitors 112 are an effective open circuit for DC signals between the control line 120 and meander line 116, and are also an effective short circuit at operating RF frequencies between the control line 120 and meander line 116. Capacitors 112, in this embodiment, are placed at terminal ends of the control line 120, and may also be placed at additional and/or other locations along the control line 120. A DC voltage source 124 is applied to the control line 120 through a PIN bias resistor 128, and a RF blocking inductor 132. A microcontroller 136 is also connected to the control line 120 through an RF blocking inductor 132. PIN diodes 140, 144 are used as switching elements to switch the meander extension 148 on and off. The microcontroller 136 provides an open collector path to ground between the DC power source 124 and the control line 120 and meander line 116 through the PIN diodes 140, 144. The RF blocking inductors 132 effectively operate as an open circuit at RF frequencies between the meander line 116 and both the DC power source 124 and the microcontroller 136, thus blocking RF signals between these elements. The microcontroller 136 provides the appropriate voltage to the switching element based on the frequency of the RF signal to be tuned. For example, in an embodiment, the antenna system 100 is used to tune RF signals in a digital television system. The frequency of the signal to be tuned is dependent upon the specific channel to be tuned for the digital television. For example, if a user desires to tune into channel 32, processing components within the digital television determine the frequency to be tuned, and provide appropriate input signals to the matching and tuning circuitry 108 and the microcontroller 136. The input signals to the matching and tuning circuitry 108 may include a voltage provided to a varactor capacitor to tune/match impedance of the antenna to the specified frequency, and the input signals from the microcontroller may include a logic on/off for the switching element. In this manner, the matching and tuning circuitry 108 is not capable of tuning over the entire frequency range of the antenna, but rather tunes the antenna over a first frequency range when the meander extension 148 is off, and tunes over a second frequency range when the meander extension 148 is on. The combination of the first and second frequency ranges covers the entire frequency range of the antenna.

Figure 4:
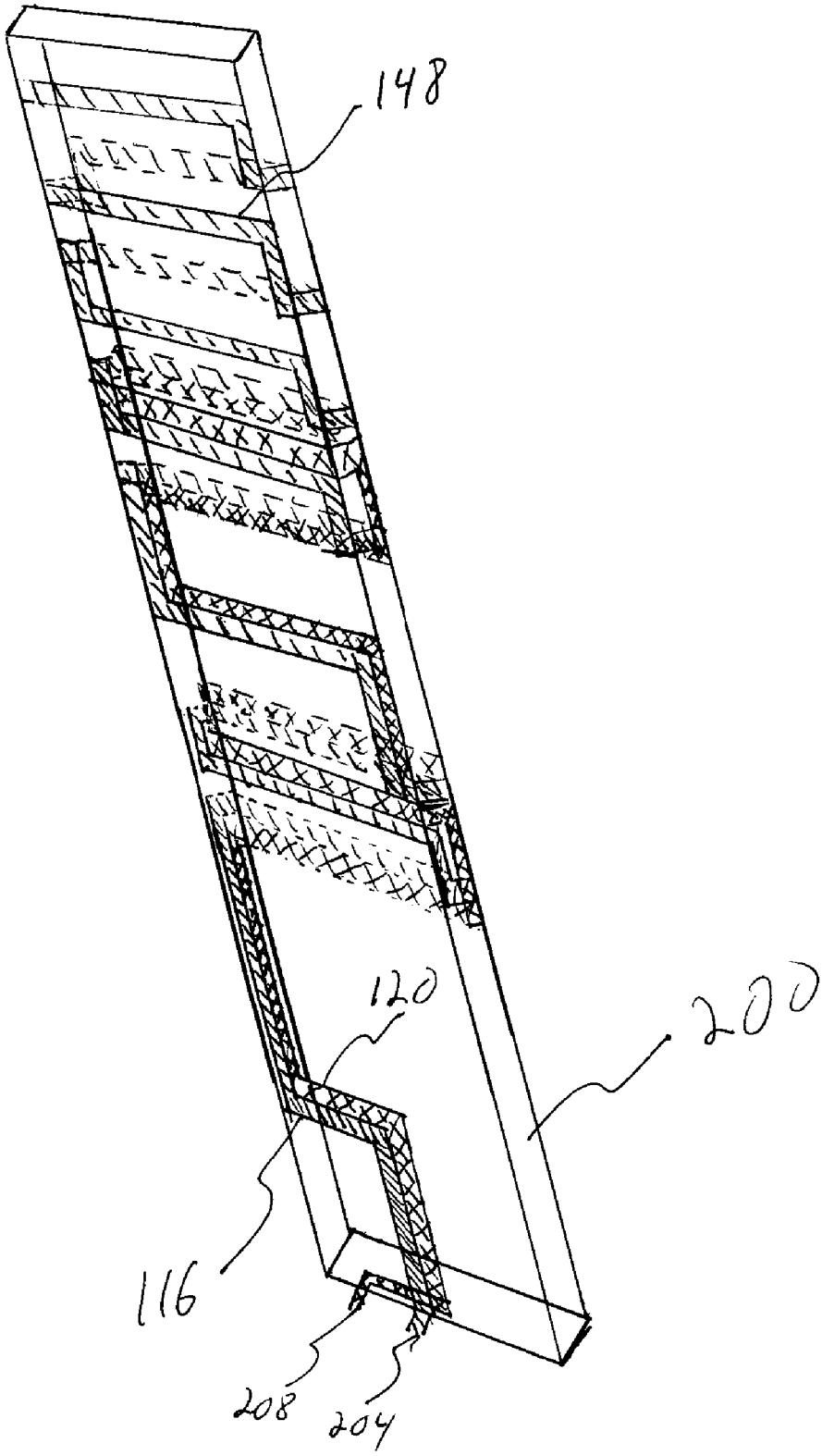
FIG. 4 is a perspective illustration of a meander line antenna of an embodiment of the present invention.

Referring now to FIG. 4, illustrated is a perspective view of a meander line and switchable meander extension and associated dielectric substrate for an embodiment. In this illustration, the meander line antenna element 116 and DC control line 120 are routed in similar fashion through the dielectric substrate 200. The meander line antenna element 116 is connected to an RF feed 204, and the DC control line is connected to a DC feed 208. The dielectric substrate 200 may be any suitable substrate, and in one embodiment is a composite dielectric comprising glass and resin (commonly known as FR4). In this embodiment, the DC control line 120 and meander line 116 are separated by a relatively thin dielectric. In one embodiment, the DC control line 120 and meander line 116 are separated by two layers of capton tape, although other dielectrics may be used. The meander extension 148 extends beyond the meander antenna 116 and has no associated control line, as a DC control signal is not required on the extension. In one embodiment, the total length of the antenna is 3.2 inches (8.13 cm), and is capable of tuning RF signals having a frequency range of about 440 MHz to 770 MHz.

Figure 5:
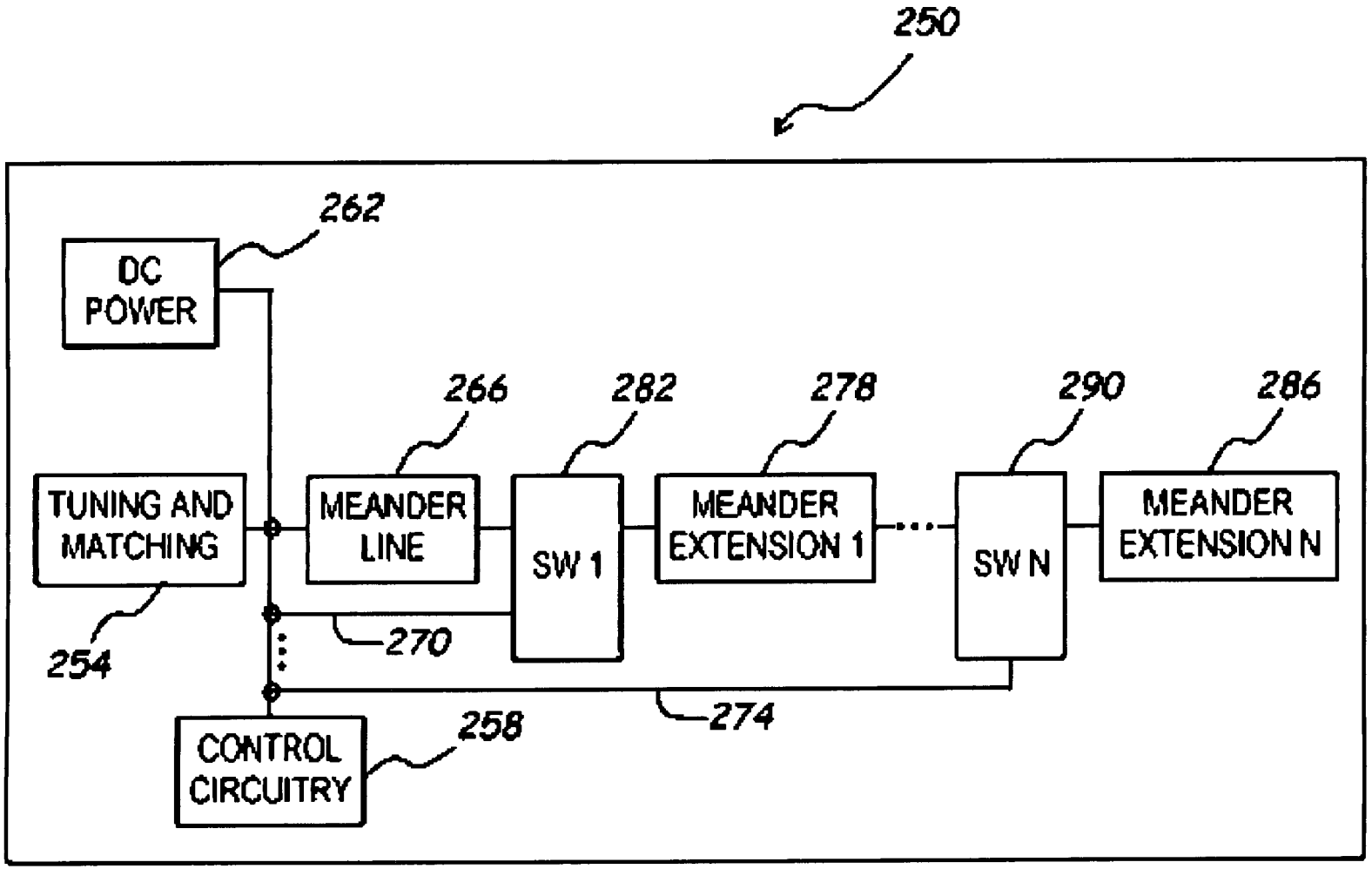
FIG. 5 is a block diagram illustration of a selectable length meander line antenna system of another embodiment of the present invention.

Referring now to FIG. 5, an antenna system 250 of another embodiment of the invention is illustrated. In this embodiment, multiple meander extensions are present with multiple switching elements that operate to switch the meander extensions on or off, thus providing additional bandwidth capability for the antenna system 250. In this embodiment, tuning and matching circuitry 254 are provided, and may be any appropriate tuning and matching circuitry for such an application. Control circuitry 258 and a DC power source 262 are coupled with a first meander line 266 and to multiple control lines 270 through 274. A first meander extension 278 is coupled to the meander line through a first switch 282. An nth meander extension 286 is coupled to the control circuitry through an nth switch 290. Thus, an antenna of this embodiment may include additional extension portions allowing for further tuning of the antenna system over broader frequency ranges while maintaining relatively simple tuning and matching circuitry.

While the invention has been particularly shown and described with reference to embodiments thereof, it will be understood by those skilled in the art that various other changes in the form and details may be made without departing from the spirit and scope of the invention.

What is claimed is:

1. A selectable length meander line antenna system, comprising:

a first meander line radiating antenna portion operably interconnected to an RF feed and a tuning circuit;

a switch element operably interconnected to said first meander line radiating antenna portion at an end thereof away from said RF feed;

a second meander line radiating antenna portion operably interconnected to said switch element; and a controller operably interconnected to said switch element, wherein said switch element is operable to receive a signal from said controller and electrically connect said second meander line radiating antenna portion to said first meander line radiating antenna portion.

2. The selectable length meander line antenna system, as claimed in claim 1, wherein said controller is operably interconnected to said switch element by a control line, and wherein said control line is routed in close proximity to said first meander line radiating antenna portion throughout the entire length of the first meander line radiating antenna portion.

3. The selectable length meander line antenna system, as claimed in claim 2, wherein said control line electrically couples with said first meander line radiating antenna portion at substantially the same frequencies.

4. The selectable length meander line antenna system, as claimed in claim 2, wherein said switch element comprises two PIN diodes connected in series between said control line and said first and second meander line radiating antenna portions.

5. The selectable length meander line antenna system, as claimed in claim 1, wherein said first meander line radiating antenna portion has a first center frequency of operation and a first range of operation, and said first and second meander line radiating antenna portions have a second center frequency and a second range of operation when said switch element electrically connects said first and second meander line radiating antenna portions, and wherein said first frequency is different than said second frequency.

6. The selectable length meander line antenna system, as claimed in claim 1, wherein said tuning circuit comprises a varactor capable of changing capacitance of the tuning circuit and changing the tuned frequency of said meander line antenna system, wherein said varactor is not capable of tuning over the entire frequency range of said antenna.

7. The selectable length meander line antenna system, as claimed in claim 1, wherein said switch element comprises a MEMS device.

8. The selectable length meander line antenna system, as claimed in claim 1, wherein said switch element comprises a relay.

9. The selectable length meander line antenna system, as claimed in claim 1, further comprising:

a second switch element operably interconnected to said second meander line radiating antenna portion at an end thereof away from said RF feed;

a third meander line radiating antenna portion operably interconnected to said second switch element; and said controller is operably interconnected to said second switch element, wherein said second switch element is operable to receive a signal from said controller and electrically connect said second meander line radiating antenna portion to said third meander line radiating antenna portion, and wherein said controller is operably interconnected with said second switch element by a second control line routed in close proximity to said first meander line radiating antenna portion and said second mender line radiating antenna portion throughout the entire length of the first and second meander line radiating antenna portions.

10. A RF system for receiving and/or transmitting RF signals over a range of RF frequencies, comprising:

an antenna element comprising a first antenna portion and an antenna extension;

an application processor;

a tuning circuit operably interconnected with said application processor and said antenna element and operable to tune said antenna element to receive and/or transmit a RF signal at a frequency received from said application processor;

a switch operably interconnected with said antenna element and operable to electrically connect/disconnect said first antenna portion and said antenna extension; and a control line operably interconnected to said switch and to said application processor, wherein said switch receives a signal from said control line and connects/disconnects said first antenna portion and said antenna extension based on said signal, and wherein said control line is in close proximity to said first antenna portion.

11. The RF system, as claimed in claim 10, wherein said antenna element is a meander antenna element having a generally serpentine configuration, and wherein said control line has a generally serpentine configuration corresponding to said first antenna portion.

12. The RF system, as claimed in claim 10, wherein said first antenna portion has a first center frequency of operation and a first range of operation, and said first antenna portion and antenna extension have a second center frequency and a second range of operation when said switch electrically connects said first antenna portion and said antenna extension, and wherein said first frequency is different than said second frequency.

13. The RF system, as claimed in claim 10, wherein said switch comprises two PIN diodes connected in series between said control line and said first antenna portion and said antenna extension.

14. The RF system, as claimed in claim 10, wherein said switch comprises a MEMS device.

15. The RF system, as claimed in claim 10, wherein said switch comprises a relay.

16. The RF system, as claimed in claim 10, wherein said control line electrically couples with said first antenna radiating portion at substantially the same frequencies.

17. A method for tuning an antenna over a frequency range that is greater than the range of frequencies capable of being tuned by tuning and matching circuitry associated with the antenna, comprising:

operating the antenna at a first frequency using a first meander line radiating antenna segment;

determining a second frequency at which the antenna is to operate;

actuating a switch to couple the first meander line radiating antenna segment with a second meander line radiating antenna segment when the second frequency is outside of a frequency range capable of being tuned using the tuning and matching circuitry and the first meander line radiating antenna segment.

18. The method for tuning an antenna, as claimed in claim 17, wherein said actuating a switch comprises:

determining, at a controller, that the second frequency is outside of the frequency range capable of being tuned using the tuning and matching circuitry and the first meander line radiating antenna segment;

providing, by the controller, a signal to a control line electrically connected to the switch, the signal operating to actuate the switch and electrically connect the first and second meander line radiating antenna segments, and wherein the control line couples with the first meander line radiating antenna segment and provides enhanced frequency bandwidth to the first meander line radiating antenna segment.

19. The method for tuning an antenna, as claimed in claim 18, wherein the first and second meander line radiating antenna segments are configured in a serpentine fashion, and wherein the control line is configured in a corresponding serpentine fashion corresponding to the first meander line radiating antenna segment and located in close proximity to the first meander line radiating antenna segment.

20. The method for tuning an antenna, as claimed in claim 17, wherein the first meander line radiating antenna segment has a first center frequency of operation and a first range of operation, and the first and second meander line radiating antenna segments have a second center frequency and a second range of operation when the switch connects the first and second meander line radiating antenna segments, and wherein the first center frequency is different than the second center frequency.

* * * * *